United States Patent [19]

Heimberger

[11] 4,139,927

[45] Feb. 20, 1979

[54] SLIDE FASTENER WITH SEPARABLE ENDSTOP MEMBERS

[75] Inventor: Helmut Heimberger, Locarno, Switzerland

[73] Assignee: Optilon W. Erich Heilmann GmbH, Cham, Switzerland

[21] Appl. No.: 769,289

[22] Filed: Feb. 11, 1977

[30] Foreign Application Priority Data

Feb. 12, 1976 [DE] Fed. Rep. of Germany ..... 2605438

[51] Int. Cl.[2] ..... A44B 19/36

[52] U.S. Cl. ..... 24/205.11 R; 24/205.11 F; 24/208 A; 24/221 R

[58] Field of Search ..... 24/205.11 R, 205.11 F

[56] References Cited

U.S. PATENT DOCUMENTS

| | | | |
|---|---|---|---|
| 1,704,579 | 3/1929 | Sanford | 24/205.11 R |
| 2,203,005 | 6/1940 | Wittenberg | 24/205.11 R |
| 3,004,318 | 10/1961 | Weiser | 24/205.11 R |
| 3,461,514 | 8/1969 | Morris | 24/205.11 R |

FOREIGN PATENT DOCUMENTS

| | | | |
|---|---|---|---|
| 117965 | 6/1930 | Austria | 24/205.11 R |
| 682960 | 6/1931 | France (Addition to No. 38450) | 24/205.11 R |
| 29568 of | 1912 | United Kingdom | 24/205.11 R |
| 363596 | 12/1931 | United Kingdom | 24/205.11 R |

*Primary Examiner*—Bernard A. Gelak
*Attorney, Agent, or Firm*—Karl F. Ross

[57] ABSTRACT

A slide fastener with separable endstop members has its endstop members formed with a plug and socket arrangement whereby one endstop member can be fitted into the other endstop member generally transversely to the plane of the slide fastener stringer. The male or plug member can form a pivot pin about which the other member is swingable into a slot in the slider.

4 Claims, 10 Drawing Figures

SLIDE FASTENER WITH SEPARABLE ENDSTOP MEMBERS

CROSS-REFERENCE TO RELATED APPLICATION

The present application is related to my copending application Ser. No. 763,556, filed Jan. 28, 1977 and entitled SLIDE FASTENER WITH SEPARABLE ENDSTOP MEMBERS.

FIELD OF THE INVENTION

The present invention relates to a slide fastener having separable endstop members and, more particularly, to a system for connecting the endstop members of a separable slide fastener so as to enable one of the memebers to pivot relative to the other generally in the plane of the slide-fastener stringer.

BACKGROUND OF THE INVENTION

From, for example, German published application (Auslegeschrift) DT-AS 14 35 818, it is known to provide an endstop arrangement for a slide fastener in which one of the endstop members is formed with a pivot pin or pintle while the other endstop member has a recess receiving the pin and swingably mounted thereon. At a location removed from the pin, the two members are provided with a connecting hook or claw which enables the swingable endstop member to be angularly displaced about the pivot pin laterally through the slot of a slider and into a position enabling the slider to couple the heads of the stringer halves together upon movement along these chains or rows of coupling heads.

Generally speaking complex means must be provided to prevent two members from swinging relative to one another and causing the opening of the slide fastener from the end at which the endstop members are provided. Such complex locking devices or elements are difficult to fabricate and relatively expensive since the interfitting members must engage one another with high precision.

Furthermore, the locking elements can require a complex manipulation of the endstop members and causes difficulties upon movement of the slider in the event the interfitting of the two endstop members is not carried out precisely.

Frequently, with such earlier arrangements, the pin could disengage from its recess during the swinging movement of one of the endstop members into engagement with the other.

In the aforementioned copending application, I have described an arrangement whereby some of these disadvantages are obviated in a particularly convenient and economical manner.

OBJECTS OF THE INVENTION

It is the principal object of the present invention to provide a slide fastener in which the aforementioned disadvantages are obviated.

Still another object of the invention is to provide a slide fastener having mutually swingable endstop members, especially for a separable slide fastener using a pivot pin, which prevents release of the pin during the swinging movement.

Still another object of the invention is to extend the principles of the above-identified application.

SUMMARY OF THE INVENTION

These objects and others which will become apparent hereinafter are attained, in accordance with the present invention, by providing a slide-fastener stringer formed with two stringer halves each having a row of coupling elememnts adapted to interdigitate and interlock with the coupling elements of the row of the other stringer half upon movement of the slider therealong, with a pair of separable endstop members, one of which is formed with a male formation and the other of which has a female formation swingably receiving the male formation of the first endstop member. According to an important feature of the invention, the two formations are connectable by press fitting the male formation within the female formation and retaining the male formation under pressure within the female formation.

According to the invention, the male formation is a pin and the female formation is a socket receiving the pin, the socket and pin extending transversely to the slide fastener plane. As a result, a press-fitted relationship between the pin and the socket is established substantially of a push-button type whereby the pin is retained with pressure within the socket.

The term "push-button connection" is thus intended to imply a retention of the pin in the socket by a friction force or some other force which prevents the pin from slipping out of the socket until the coupling of the two endstop members is complete.

The press fitting can be accomplished by a frictional engagement of the pin in the female member or socket, by a detent configuration of the two and/or by providing them as a bayonet coupling adapted to lock the pin within the socket upon relative angular displacement of the two endstop members.

In a preferred mode of construction, the pin is provided with a head which is slightly larger than the normal opening of the socket so that the latter is expanded or the head of the pin is resiliently compressed as the pin is forced into the socket.

The bayonet coupling can be provided in addition and, to this end, the head may be provided with a non-circular formation receivable in a corresponding non-circular configuration of the socket in one relative angular position of the two endstop members, the members being thereupn twisted relative to one another so that the head cannot be withdrawn through the socket.

Thus, according an important feature of the invention, the pin is press fitted into the socket and an angular displacement of the two members thereupon locks the assembly together. Instead of a bayonet arrangement at the pin, the locking can be affected by causing a tongue (or a blade) on one of the members to enter a slot formed on the slide-fastener half carrying the other member. This slot can, as described in the aforementioned copending application, be provided directly in the latter endstop member and/or one or more coupling elements mounted on the stringer half carrying this latter endstop member, or solely in such coupling elements.

According to still another feature of the invention, as described in more detail in the aforementioned copending application, the swingable endstop member can engage the other stringer half so that it functions as a double-arm lever, the ends of the lever being respectively the pivot assembly and a hook, claw or other detent at the opposite end of the endstop member. At an intermediate location between the pivot assembly and this detent, the endstop member can bear upon the opposite stringer half, e.g. in the slot mentioned previously, so that the pivot assembly is placed under a stress transverse to the axis of the stringer and in the plane thereof.

The male formation is thus stressed against the female formation or the two formations are stressed against one another by this lever arrangement.

When the slot is provided in coupling elements on one stringer half, the endstop member of the other stringer half can be formed as a blade in a region in which such coupling elements are omitted.

The advantages of the present system are several in number. Firstly, immediately upon assembly of the endstop members, i.e. the introduction of the pin in the socket, there is a retention of the pin which prevents inadvertent separation of the two endstop members. Upon angular displacement of the two endstop members, e.g. to bring the swingable endstop member laterally into the slot provided in the slider, the pin in locked against axial withdrawal from the socket.

The operation of the endstop members, upon connection, is greatly simplified since the pin need be pressed only lightly into the socket if locking is to be effected during the pivotal movement.

Still another advantage resides in the fact that the introduction of the pin into the socket can be effected by feel alone and hence manipulation is simplified in this respect as well. Furthermore, the pin and socket arrangement permits automatic positioning of the endstop members so that a complex alignment process can be avoided. Finally, special elements serving as locking formations can be avoided, particularly in the case in which a bayonet coupling of the pin and socket is provided.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
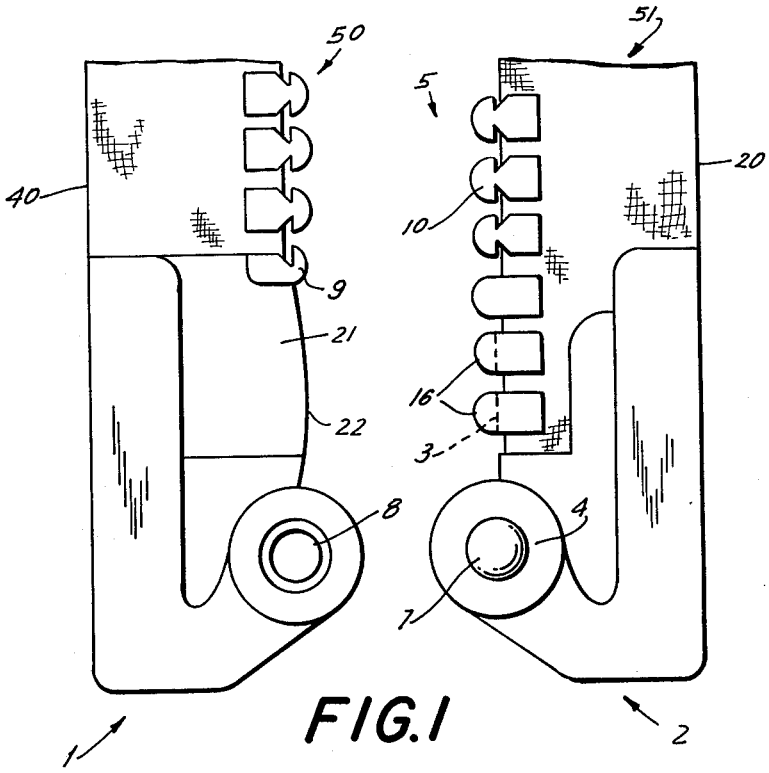
FIG. 1 is a diagrammatic plan view of the end of a separable slide fastener with the two endstop members detached.

In the drawing, the various structures have been shown somewhat diagrammatically for clarity.

Figure 2:
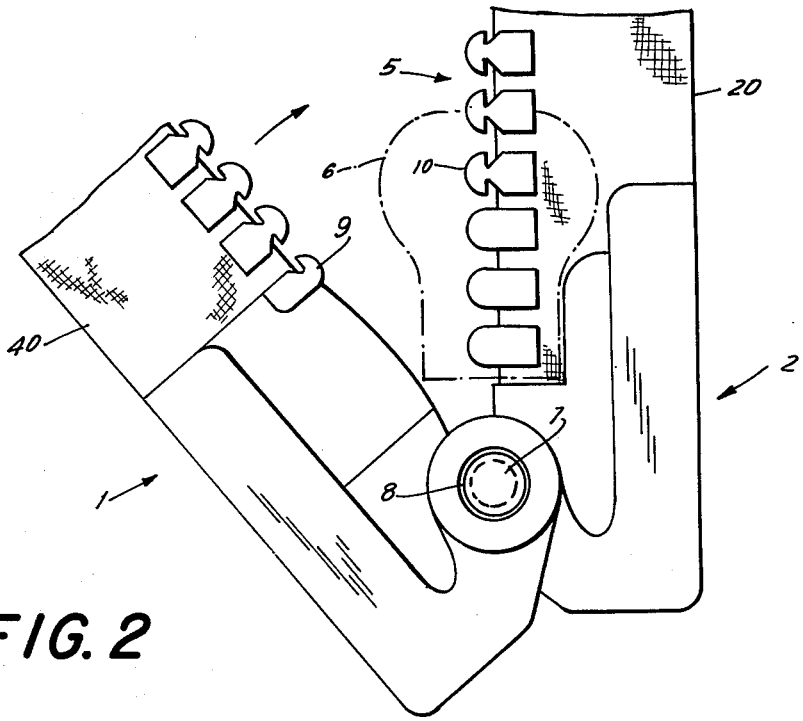
FIG. 2 is a plan view showing the two endstop members interconnected but prior to the final angular displacement thereof.
Figure 3:
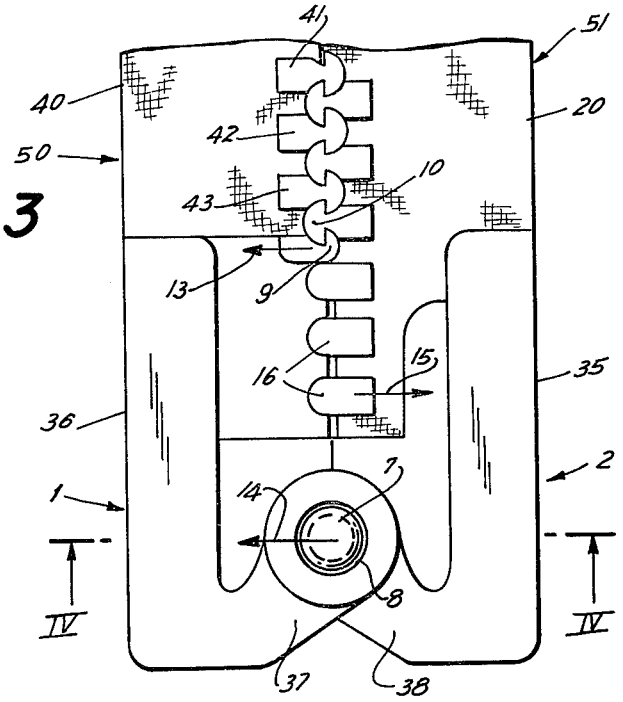
FIG. 3 is a view of the assembly of FIGS. 1 and 2 with the endstop members fully connected.

In FIGS. 1–4, for example, I have shown a separable slide fastener comprising a pair of stringer halves 50 and 51 each of which is formed with a tape 40, 20, provided with a row of coupling elements or heads 41, 42, 43 or 10, the heads being adapted to interdigitate as shown in FIG. 3, upon movement of a slider 6 along a stringer.

Figure 7:
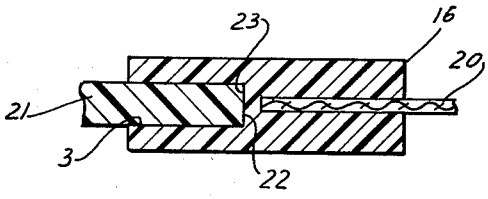
FIG. 7 is a cross-sectional view taken generally along the line VII—VII of FIG. 3.

At one end of the stringer, the slide-fastener halves 50 adn 51 are provided with endstop members 1 and 2, respectively, which can be molded by synthetic resin material directly upon the respective tapes 40 and 20. The endstop member 1 is shown to be swingable and can have a blade portion 21 adapted to be received in slots 3 of coupling element 16 open on the direction of the opposite stringer half. The functions of these slots and their configurations will be more readily apparent from FIG. 7 and the aforementioned copending application.

Figure 4:
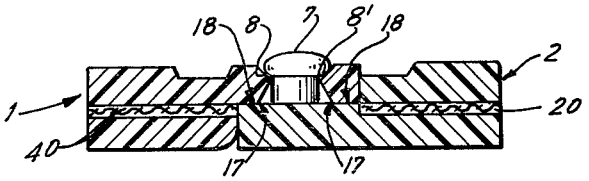
FIG. 4 is a cross-sectional view taken generally along the line IV—IV of FIG. 3.

A boss 4 on the endstop member 2 carries a pivot pin 7 which, as can be seen in FIG. 4, is provided with a rounded head adapted to be pressed past an inwardly extending bulge 8' in a socket 8 formed on the other endstop member 1 so that the head is retained by friction upon being press fitted in the socket.

The open condition of the stringer has been illustrated in FIG. 1. According to the invention, the socket is pressed over the head of the pin 7 or the pin 7 is pressed into the socket 8 as shown in FIG. 2 and the slider is moved downwardly to the position shown in dot-dash lines in this FIGURE. The endstop member 1 is then swung in the clockwise sense (FIG. 2) into the closed position illustrated in FIG. 3 in which the blade or tongue 21 enters the slider laterally, a hook 9 at the end of the member 1 remote from the socket 8 grips one of the coupling elements 10 of the other stringer half, and the slider can then be displaced upwardly to lock the rows of coupling elements together.

According to the invention and as illustrated in FIG. 4, the pin of the male formation 7 is press fitted into the socket 8 in a push-button connection, the head 7 enabling the pin to be pressed out of the socket in the opposite direction when disassembly is required. The head of the pin 7 and the bulge 8' form a resilient frictional connection which preliminarily locks the pin in the socket during the swinging movement illustrated in FIG. 2. Once the blade 21 is received in the slot 3, however transverse displacement of the pin 7 out of the socket cannot occur.

Figure 5:
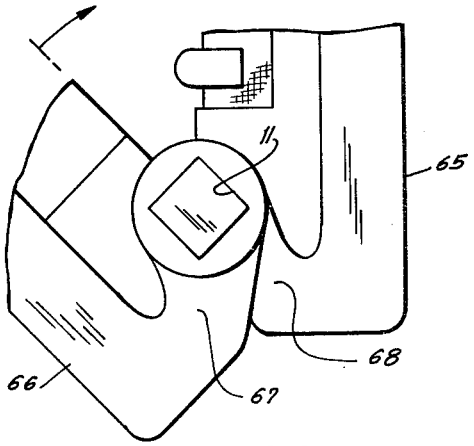
FIG. 5 is a fragmentary view similar to FIG. 2 illustrating an embodiment of the invention provided with a bayonet coupling.
Figure 6:
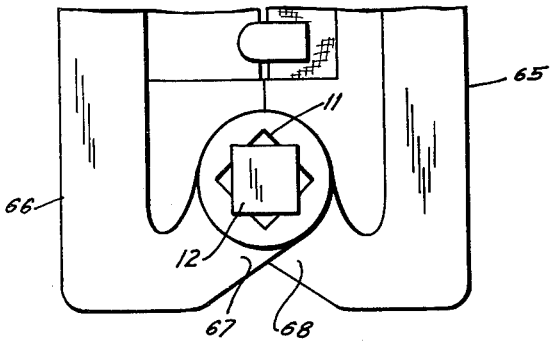
FIG. 6 is a view of the bayonet connection of FIG. 5, fully engaged.

As can be seen in FIGS. 5 and 6, additional locking facilities can be provided in the form of a noncircular (in this case square) head 12 which is press fitted into a correspondingly-shaped socket 11 in one angular position of the two endstop members 65, 66, but is angularly offset from the socket in the closed position as illustrated in FIG. 6, thereby preventing displacement of the pin out of the socket.

In all of the embodiments illustrated, the endstop member can be formed with ribs 67, 68 running along the outer edges of the stringer, the bottom thereof and leading to the pin or the socket. Similar ribs have been shown at 35 and 36 in FIG. 3 and are extended at 37 and 38 to the socket and pin, respectively.

The blade 21 can project outwardly slightly as shown at 22 to bear upon the root or base of the slot 3 (see FIG. 7) to form a fulcrum so that, when the hook 9 engages a coupling element 10 (FIG. 3) the member 1 functions as a double-arm lever, applying a force in the direction of arrow 15, the reaction forces at 13 and 14 respectively retaining the hook 9 against self-release, and applying a force 14 which presses the pin 7 against the wall of the socket. This constant stress at the endstop members further secures them together until the hook 9 is intentionally released.

The pin 7 can be provided on the swingable member 1 and the socket 8 on the nonswingable member 2, reversing the configuration shown in FIG. 4. In the region of the blade 21, the coupling elements 41, 43, etc. of the slide-fastener half 50 can be removed. However, if desired, the fulcrum action can be provided by coupling elements carried by the swingable member 1.

Figure 8:
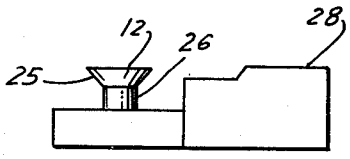
FIG. 8 is an elevational view of a bayonet coupling pin similar to that which is employed in the embodiments of FIGS. 5 and 6.
Figure 9:
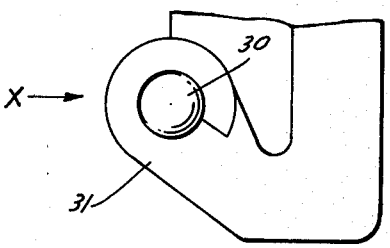
FIG. 9 is a plan view illustrating another feature of the invention.
Figure 10:
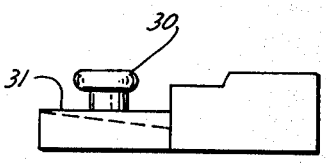
FIG. 10 is a view taken in the direction of arrow X of FIG. 9.

To permit automatic driving of the pin 7 into the socket 8, the members can be formed with spiral ramps such as have been illustrated at 31 in FIGS. 9 and 10 around the pin 30 so that, upon swinging movement in one sense the ramp cams the head 30 into the socket while swinging movement in the opposite sense automatically releases the head from the socket. As shown in FIG. 8, the square head of pin 12 can be provided with a conical lower surface 25 above the shank 26 on an endstop member 28 to facilitate the swingin movement of the bayonet arrangement illustrated in FIGS. 5 and 6.

I claim:

1. A slide fastener comprising a pair of stringer halves each formed with a row of coupling elements adapted to interdigitate with the coupling elements of the other row, and an endstop member on each of said stringer halves, and a slider displaceable along said rows for coupling and decoupling the elements thereof, one of said endstop members being formed with a pivot pin defining a pivot axis transverse to the plane of the slide fastener, the other of said endstop members being formed with a socket receiving said pin and press-fittingly engaging same while enabling relative swinging movement of said endstop members to introduce a portion of an endstop member laterally into said slider, said members being formed around said socket and pin respectively with mutually engageable surfaces in the form of spiral ramps.

2. The slide fastener defined in claim 1, further comprising means for engaging said coupling members remote from said socket and said pin, one of said socket members forming a double-arm lever fulcrumed between said means and said pin and pressing said pin into said socket upon engagement of said endstop members by said means.

3. The slide fastener defined in claim 1 wherein said pin is provided on the one of the endstop members which is swingable about the other endstop member.

4. The slide fastener defined in claim 2 wherein said fulcrum is formed by a blade on a swingable one of said endstop members and bearing against the nonswingable one of said endstop members.

* * * * *